US008375830B1

(12) United States Patent
Yang

(10) Patent No.: US 8,375,830 B1
(45) Date of Patent: Feb. 19, 2013

(54) RATCHET WRENCH

(76) Inventor: Yueh-Ying Yang, Taichung (TW)

( * ) Notice: Subject to any disclaimer, the term of this patent is extended or adjusted under 35 U.S.C. 154(b) by 0 days.

(21) Appl. No.: 13/451,573

(22) Filed: Apr. 20, 2012

(51) Int. Cl.
*B25B 13/46* (2006.01)

(52) U.S. Cl. ..... 81/60; 81/63; 81/62; 192/43.1

(58) Field of Classification Search ..... 81/60–63.2
See application file for complete search history.

(56) References Cited

U.S. PATENT DOCUMENTS 1,261,092 A * 4/1918 Allen ..... 81/60
2,800,821 A * 7/1957 Fruscella ..... 81/60
2,982,161 A * 5/1961 Angquist et al. ..... 81/62
2011/0067531 A1* 3/2011 Suzuki ..... 81/63

* cited by examiner

*Primary Examiner* — Monica Carter
*Assistant Examiner* — Melanie Alexander

(57) ABSTRACT

A ratchet wrench includes a main body provided with a driving gear and a driven gear and having a receiving groove disposed with ratchet teeth on the inner wall. The driving gear is ball-shaped and has the outer wall of each gear tooth forming an arc-shaped surface, and a concave surface is formed between every two gear teeth of the driven gear to match the arc-shaped surface of the gear teeth of the driving gear. Each gear tooth of the driven gear is provided with plural ratchet teeth to be engaged with the ratchet teeth of the receiving groove. An interaction member is received inside the driven gear, having one end connected with an orientating member and another end positioned on a cover plate. A pressing piece is fixed on the interactive member and a spring is positioned between the pressing piece and the interactive member.

2 Claims, 9 Drawing Sheets

RATCHET WRENCH

BACKGROUND OF THE INVENTION

1. Field of the Invention

This invention relates to a ratchet wrench, particularly to one facilitating to change the rotating direction of a driving gear by change-over of an orientating member, able to achieve excellent efficacy of engaging and braking for the driving gear. In addition, the sleeve-engaging rod of the driving gear can be adjusted backward and forward in angle to match with different restricted spaces for adjusting the force-applying angles of a tool when operated, convenient in use and able to carry out driving work with great stability.

2. Description of the Prior Art

Generally, a ratchet wrench cooperating with different sleeves is employed for locking and detaching different kinds of bolts or nuts. A conventional ratchet wrench 1, as shown in FIG. 1, includes a main body 10 formed with an accommodating groove 100 and a receiving groove 101, the accommodating groove 100 bored with a through hole 102, and the receiving groove 101 provided with a control grip hole 103 and having a wall disposed with a recessed hole 104. A driving gear 11 is received in the accommodating groove 100, and an adjusting block 12 is set in the receiving groove 101 of the main body 10, with the gear teeth 110 of the driving gear 11 meshed with the teeth 120 at one side of the adjusting block 12. The driving gear 11 is mounted thereon with a sleeve-engaging post 111 while the adjusting block 12 has an intermediate portion of another side provided with a projection 121 having two sides respectively formed with a recessed arcuate surface 122. The recessed hole 104 of the main body 10 is fixed therein with a positioning ball 13 and a spring 14, the positioning ball 13 resisting against one of the two recessed arcuate surfaces 122. A control grip 15 is positioned at an outer side of the main body 10 and connected with the adjusting block 12 by a shaft rod 16, and a blocking plate 17 is to be secured on the main body 10 by fixing members 18 and bored with a through hole 170 for the sleeve-engaging post 111 of the driving 11 to be inserted therethrough and a shaft hole 171 for receiving the shaft rod 16 therein. Thus, when the control grip 15 is operated to actuate the adjusting block 12 to rotate and have one end transferred to closely lean on one sidewall of the receiving groove 101 of the main body 10, the driving gear 11 will be held and braked by the adjusting block 12 to carry out one-way driving.

However, the engagement of the driving gear 11 of the conventional ratchet wrench 1 with the teeth 120 of the adjusting block 12 is point contact or line contact; therefore, the driving gear 11 and the teeth 120 of the adjusting block 12 cannot stably mesh with each other for transmission, likely to produce tooth skipping and indefinite gearing. In addition, when the adjusting block 12 is actuated to carry out braking to the driving gear 11, it is only by mutual resisting and engaging of the wall surfaces of the adjusting block 12 and of the receiving groove 101, which are smooth surfaces unable to produce great frictional force, thus failing to attain good effect of engaging and braking and also apt to slip off. Moreover, the conventional ratchet wrench 1 can only carry out one-way or bilateral rotation, and the sleeve engaging post 111 of the driving gear 11 is perpendicular to the holding portion of the main body 10 so it is impossible to adjust the force-applying angles of the sleeve engaging post 111 to match with different restricted spaces during operating, resulting in inconvenience in use and in operation.

SUMMARY OF THE INVENTION

The objective of this invention is to offer a ratchet wrench able to stably change the rotating direction of a driving gear for attaining excellent efficacy of engaging and braking, and the sleeve-engaging rod of the driving gear is adjustable in angle to match with different restricted spaces for adjusting force-applying angles of a tool when operated, convenient in use and stable in driving.

The ratchet wrench in the present invention includes a main body formed with an operating end having one side provided with a recessed surface disposed therein with an accommodating groove and a receiving groove communicating with each other. The operating end of the main body has another side bored with a through hole passing through the receiving groove, and an orientating member is set at the outer side of the main body. A driving gear received in the accommodating groove of the main body is provided thereon with gear teeth and a sleeve-engaging rod. A driven gear fixed in the receiving groove of the main body is formed with gear teeth to be meshed with the gear teeth of the driving gear. A cover plate to be covered on the recessed surface of the main body is bored with a through hole for the sleeve-engaging rod of the driving gear to be inserted therethrough.

The feature of this invention is that the receiving groove of the main body has its inner wall provided with ratchet teeth, and the driving gear is ball-shaped and has the outer wall of each gear tooth formed into an arc-shaped surface. A recessed arcuate surface is formed between every gear teeth of the driven gear to match with the arc-shaped surface of each gear tooth of the driving gear, and the driven gear has each gear tooth disposed with a ratchet tooth to be meshed with the ratchet tooth on the inner wall of the receiving groove of the main body and is bored with a through hole for receiving an interactive member therein. The interactive member has one end connected with the orientating member positioned at the outer side of the main body and another end fixed on the cover plate, further bored with an insert hole. A pressing piece to be mounted on the interaction member and received in the through hole of the driven gear is provided with a projecting post to be inserted in the insert hole of the interactive member. A spring is fitted on the projecting post of the pressing piece and positioned between the pressing piece and the interactive member.

The operating end of the main body has another side disposed with a recessed groove at a location corresponding with the receiving groove, and the recessed groove is bored with a plurality of insert holes communicating with the recessed groove. The interaction member has one end formed with a positioning projection and another end secured with a positioning stud. A blocking plate is to be assembled in the recessed groove of the main body, having a through hole for the positioning projection of the interactive member to be inserted therethrough and plural threaded holes at locations respectively corresponding with the insert holes of the recessed groove of the main body. The orientating member is positioned at the outer side of the blocking piece and provided with an insert hole inserted therein with a fixing member, which is to be secured on the positioning projection of the interactive member. The cover plate is bored with a positioning hole for the positioning stud at one end of the interactive member to be inserted therein, and plural insert holes at locations corresponding with the insert holes of the recessed surface of the main body. Plural fixing members are respectively inserted through the insert holes of the cover plate and through the insert holes of the main body and then threadably fixed in the threaded holes of the blocking plate.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
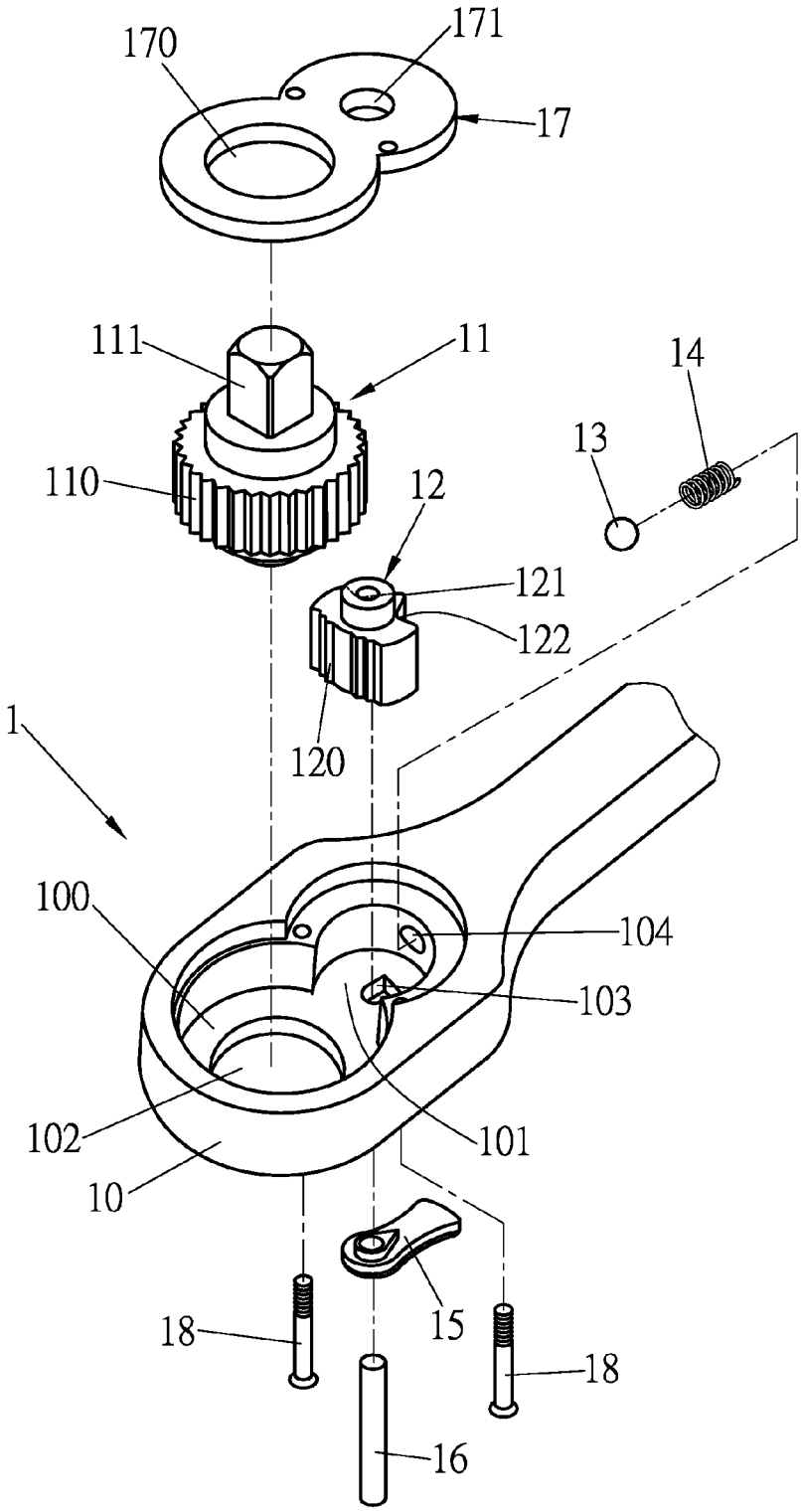
FIG.1 (PRIOR ART)
FIG. 1 is an exploded perspective view of a conventional ratchet wrench.
Figure 2:
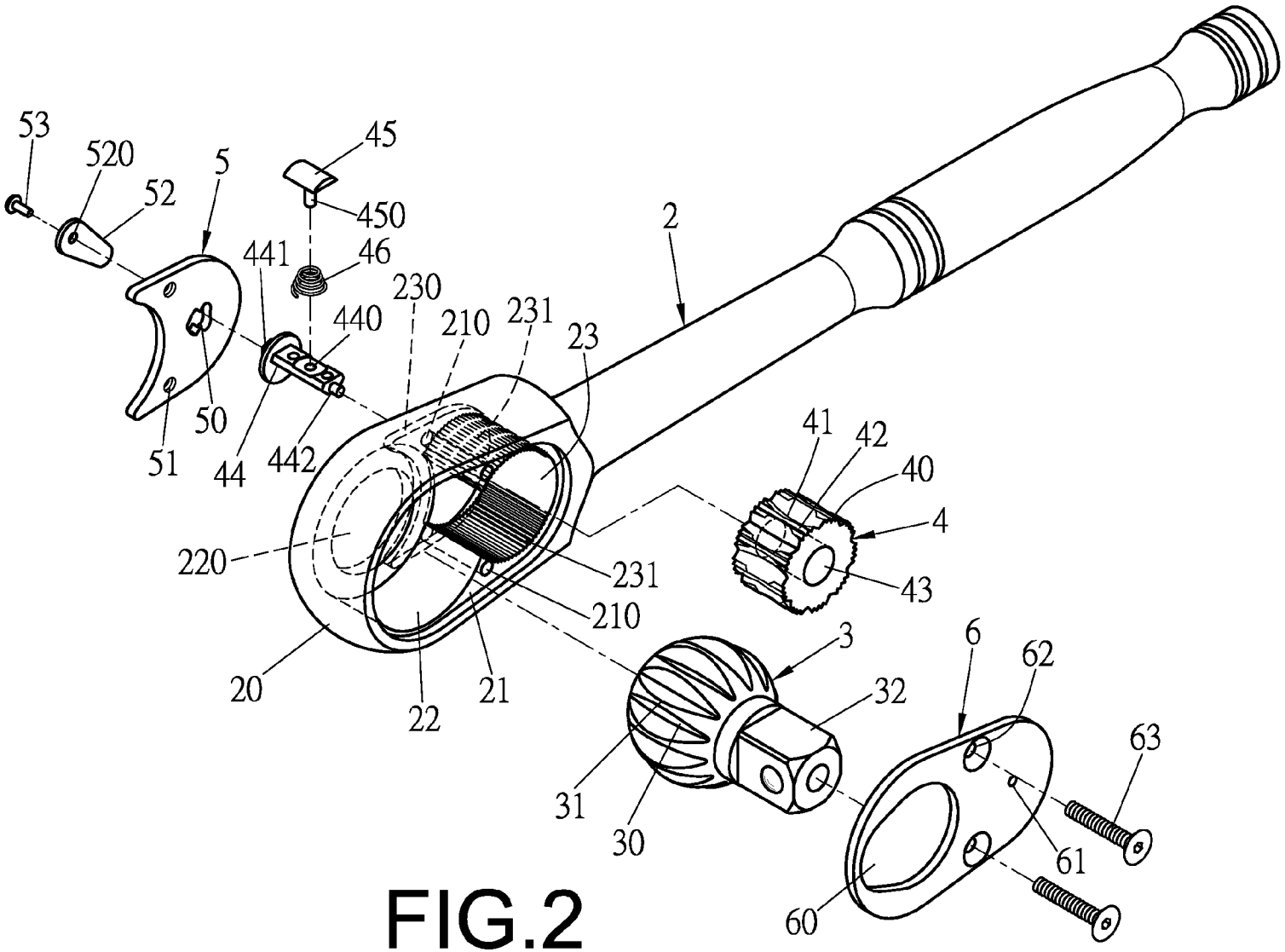
FIG. 2 is an exploded perspective view of a ratchet wrench in the present invention.
Figure 3:
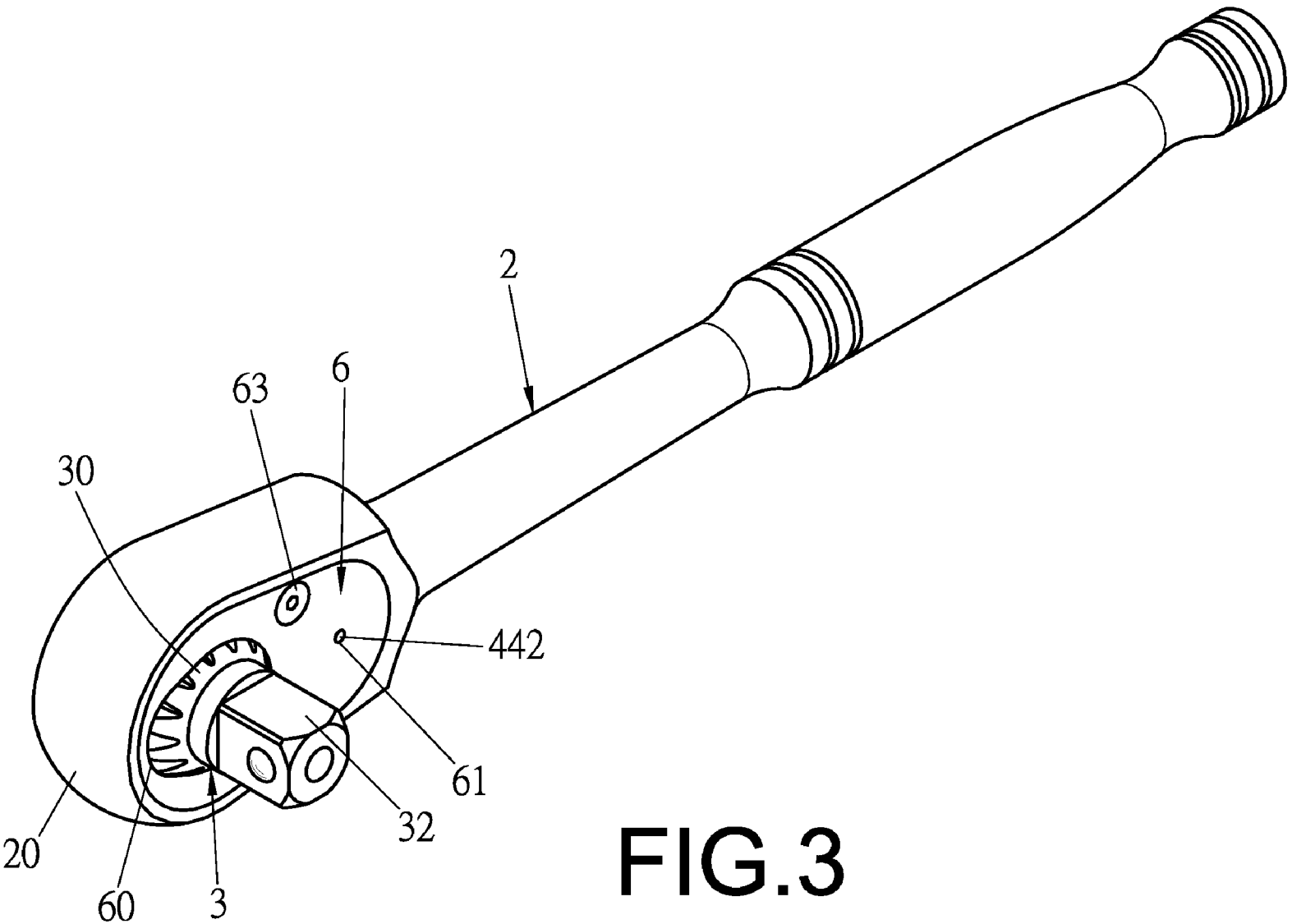
FIG. 3 is a perspective view of the ratchet wrench in the present invention.

A preferred embodiment of a ratchet wrench in the present invention, as shown in FIGS. 2-5, includes a main body 2, a driving gear 3, a driven gear 4, a blocking plate 5 and a cover plate 6 as main components combined together.

The main body 2 has one side of its operating end 20 formed with a recessed surface 21 provided therein with an accommodating groove 22 and a receiving groove 23 communicating with the accommodating groove 22. The operating end 20 has another side bored with a through hole 220 communicating with the accommodating groove 22, further having another side formed with a recessed groove 230 at a location corresponding with the receiving groove 23. The recessed surface 21 is bored with a plurality of insert holes 210 communicating with the recessed groove 230, and the receiving groove 23 has two oppositely sides of its inner wall respectively disposed with a plurality of ratchet teeth 231.

The driving gear 3 is ball-shaped to be received in the receiving groove 22 of the main body 2, having the outer wall surface of each gear tooth 30 formed into an arc-shaped surface 31 and mounted thereon with a sleeve-engaging rod 32.

The driven gear 4 is received in the receiving groove 23 and has its gear teeth 40 meshed with the gear teeth 30 of the driving gear 3. A concave surface 41 is formed between every gear teeth 40 of the driven gear 4 to match with the arc-shaped surface 31 of the gear tooth 30 of the driving gear 3, and each gear tooth 40 is provided with plural ratchet teeth 42. The driven gear 4 is axially bored with a through hole 43, and an interaction member 44 with an insert hole 440 is inserted in the through hole 43, having one end formed with a positioning projection 441 and another end secured with a positioning stud 442. A pressing piece 45 is set on the interactive member 44 and positioned in the through hole 43 of the driven gear 4 and further fixed thereon with a projecting post 450. A spring 46 is fitted on the projecting post 450 and located between the pressing block 45 and the interactive member 44.

The block plate 5 to be assembled on the recessed groove 230 of the main body 2 is disposed with a through hole 50 and plural threaded holes 51 at locations corresponding with the insert holes 210 of the recessed groove 230 of the main body 2. An orientating member 52 positioned at an outer side of the blocking plate 5 is bored with an insert hole 520, and a fixing member 53 is inserted through the insert hole 520 and secured with the positioning projection 441 at one end of the interaction member 44.

The cover plate 6 to be covered on the recessed surface 21 of the main body 2 is provided with a through hole 60, and a positioning hole 61 for the positioning stud 442 of the interaction member 44 to be inserted therethrough, further bored with insert holes 62 at locations respectively corresponding with the insert holes 210 of the recessed surface 21 of the main body 2, with a screw inserted in each insert hole 62.

In assembling, referring to FIGS. 2-5, firstly, the positioning projection 441 at one side of the interaction member 44 is inserted in the through hole 50 of the blocking plate 5, and the orientating member 52 is secured on the positioning projection 441 of the interaction member 44 by the fixing member 53, letting the orientating member 52 positioned at an outer side of the blocking plate 5 to fix the blocking plate 5 on the recessed groove 230 of the main body 2. Next, the spring 46 is fitted on the projecting post 450 of the pressing piece 45 and the projecting post 450 is inserted in the insert hole 440 of the interactive member 44, letting the interaction member 44 together with the pressing piece 45 and the spring 46 received in the receiving groove 23 of the main body 2. Subsequently, the driven gear 4 is set in the receiving groove 23, letting the interactive member 44, the pressing piece 45 and the spring 46 positioned in the through hole 43 of the driven gear 4 and then the driving gear 3 is received in the accommodating groove 22 of the main body 2, letting the gear teeth 30 of the driving gear 3 meshed with the gear teeth 40 of the driven gear 4, and the threaded holes 51 of the blocking plate 5 aligned to the insert holes 210 of the main body 2. Afterward, the cover plate 6 is covered on the recessed surface 21 of the main body 2, letting the sleeve-engaging rod 32 in the accommodating groove 22 of the main body 2 inserted out of the through hole 60 of the cover plate 6 and the positioning stud 442 of the interactive member 44 in the through hole 43 of the driven gear 4 inserted in the positioning hole 61 of the cover plate 6. Lastly, the screws 63 are respectively inserted through the insert holes 62 of the cover plate 6 and the through holes 210 of the main body 2 and then screwed in the threaded holes 51 of the blocking plate 5 to have the driving gear 3 and the driven gear 4 together with its inner members respectively secured in the accommodating groove 22 and the receiving groove 23 of the main body 2, thus finishing assembly of the ratchet wrench.

Figure 4:
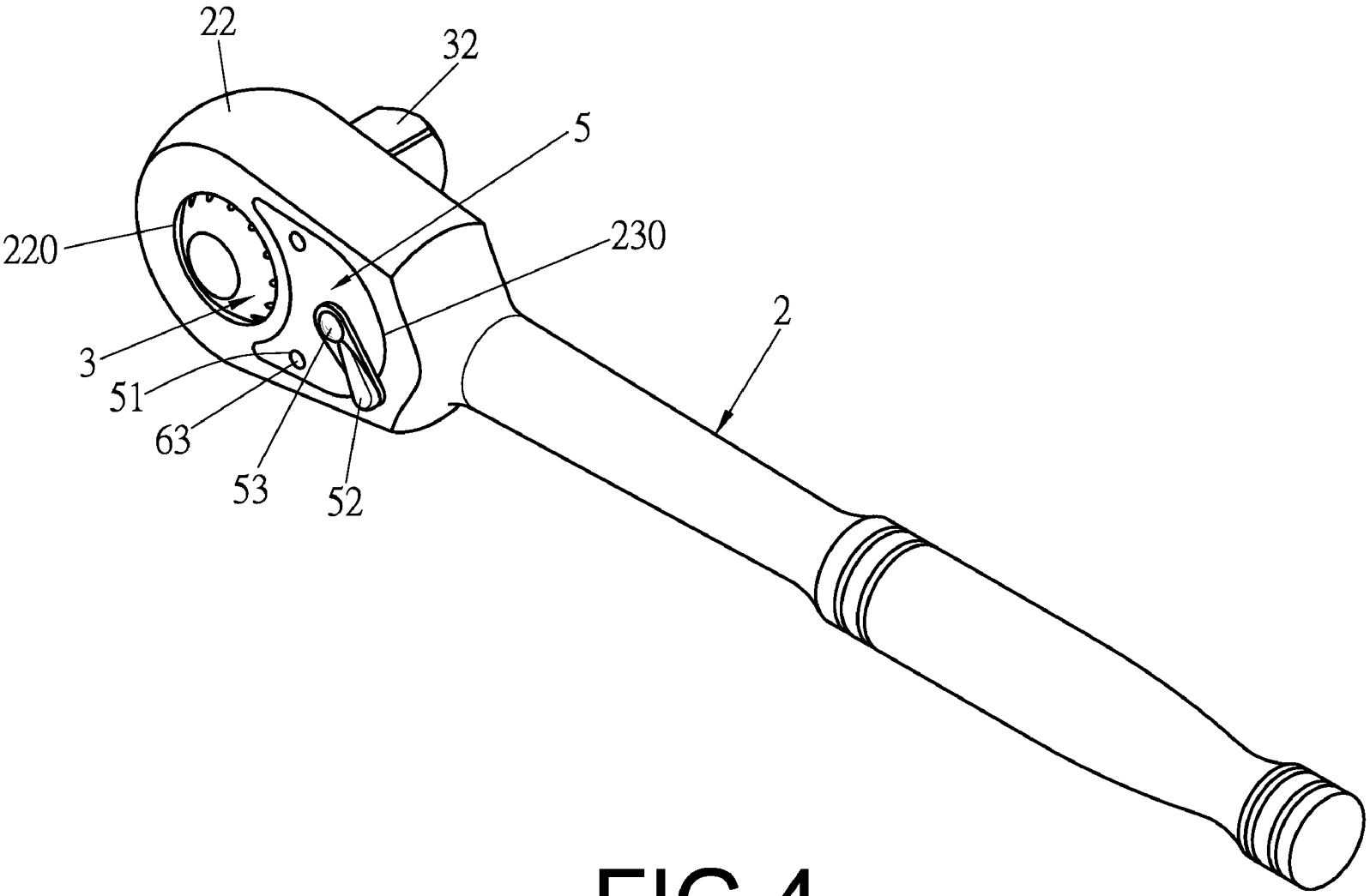
FIG. 4 is a perspective view of the ratchet wrench at another angle in the present invention.
Figure 5:
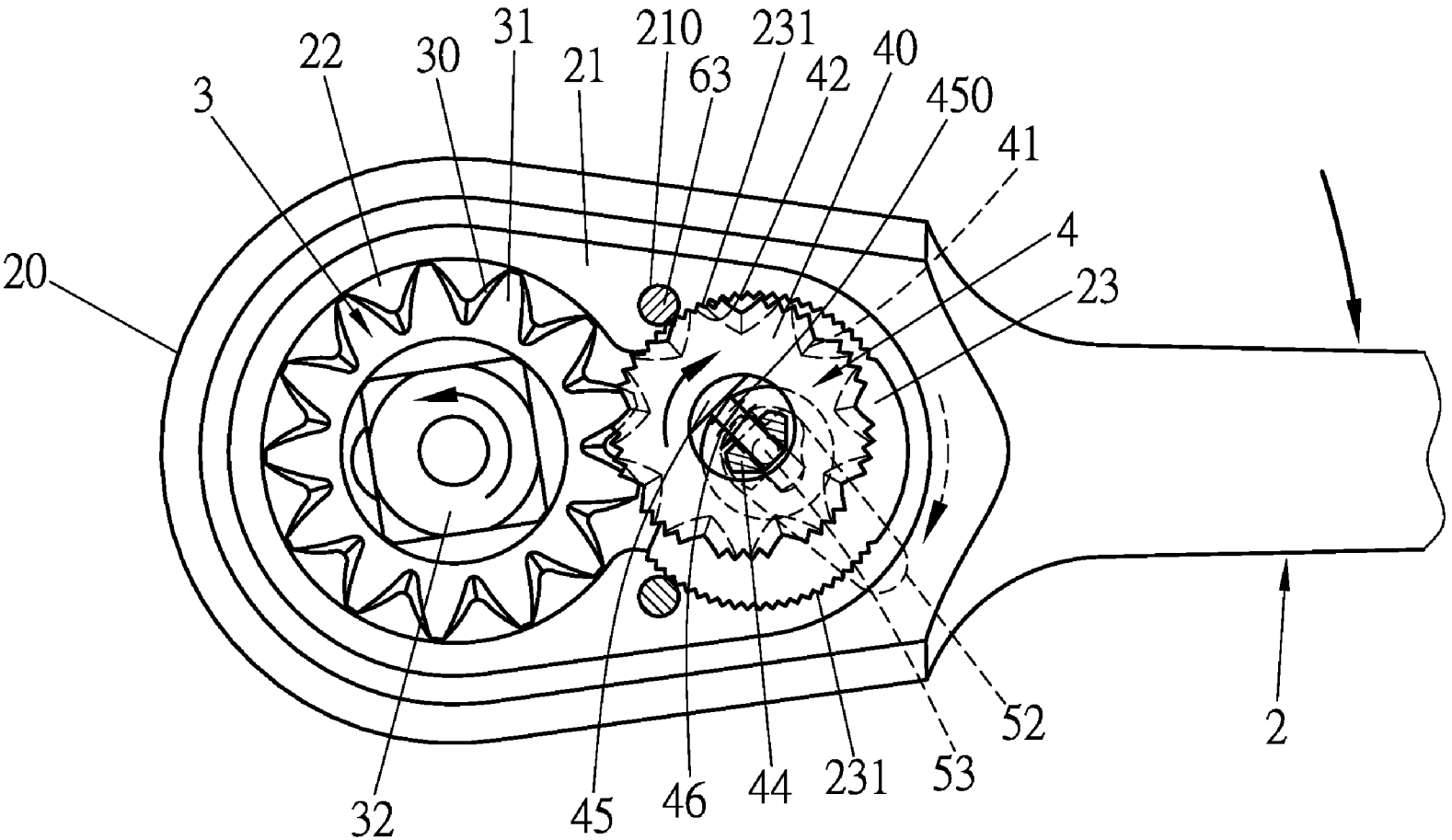
FIG. 5 is a schematic view of a driving gear changed over to an engaging and braking direction in the present invention.
Figure 6:
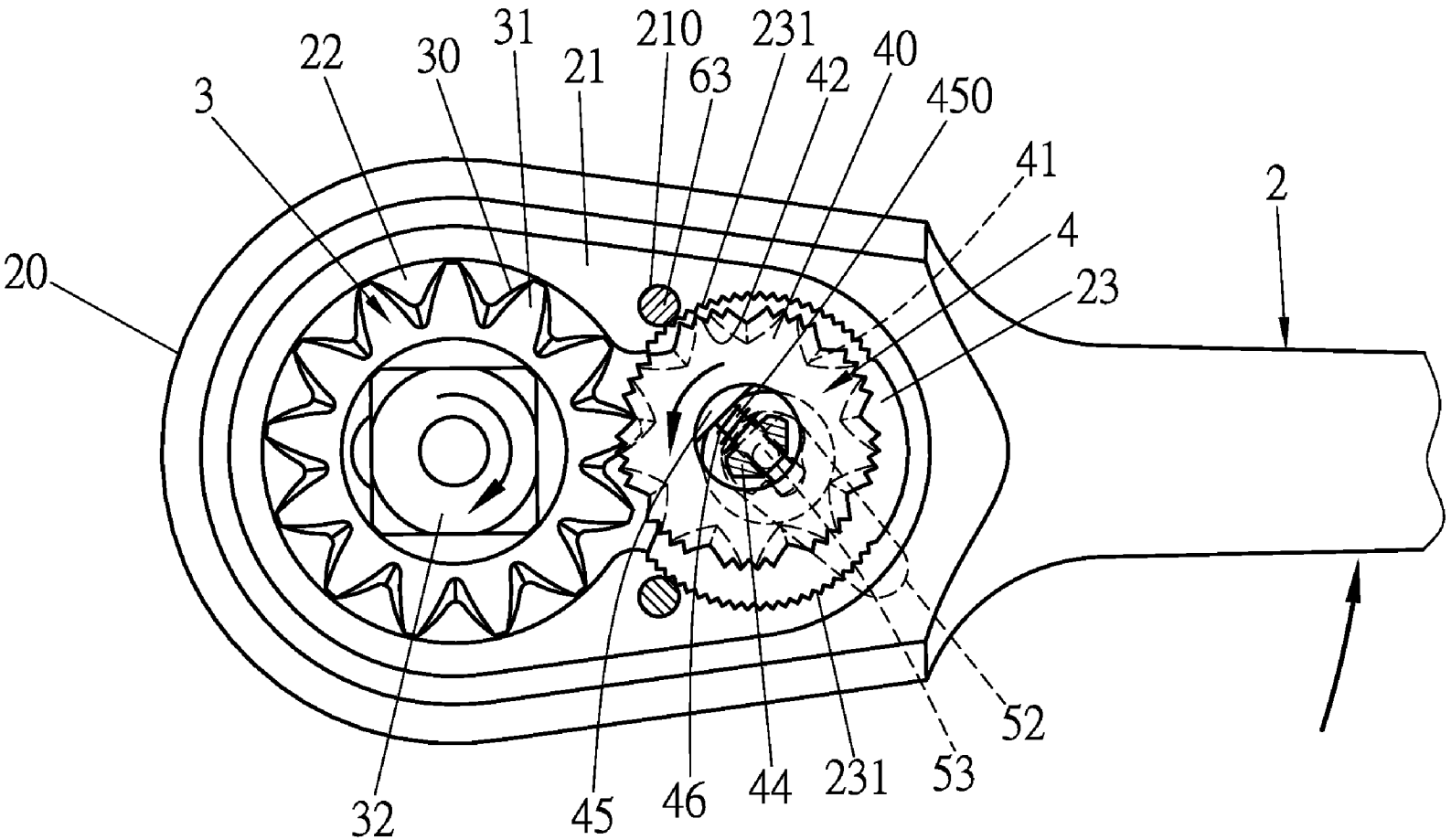
FIG. 6 is a schematic view of the driving gear in an idling state in the present invention.
Figure 7:
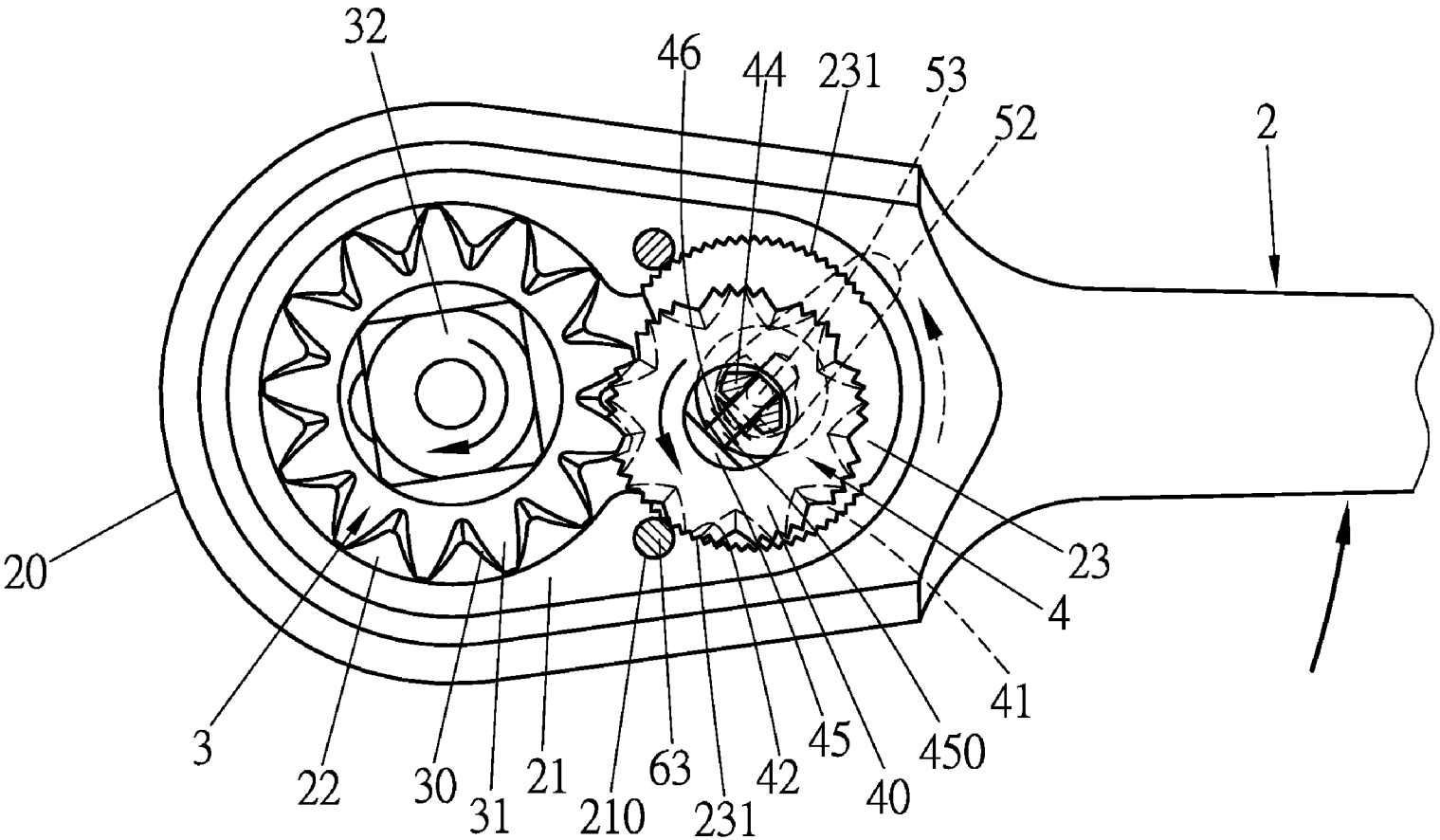
FIG. 7 is a schematic view of the driving gear changed over to another engaging and braking direction for carrying out engagement and braking in the present invention.

In using, referring to FIGS. 4-9, firstly, the orientating member 52 is changed over to a direction in which the main body 2 is expected to turn. When the main body 2 is to be turned clockwise for use, the orientating member 52 is pulled clockwise to the same direction of the main body 2, as shown in FIGS. 4 and 5. Simultaneously, the orientating member 52 will drive the interactive member 44 to rotate to actuate the pressing piece 45 to rotate in the through hole 43 of the driven gear 4. At this time, the pressing piece 45 will be elastically pushed by the spring 46 to actuate the driven gear 4 to shift in the receiving groove 23 of the main body 2. Pushed elastically by the spring 46, the driven gear 4 will be moved upward to closely lean on the upper inner wall of the receiving groove 23 of the main body 2, as shown in FIG. 5 and synchronously, the ratchet teeth 42 on the gear teeth 40 of the driven gear 4 will be engaged with the ratchet teeth 231 of the upper inner wall of the receiving groove 23, leaving the lower portion of the receiving groove 23 formed into a space. When the main body 2 is rotated clockwise for use, the gear teeth 30 of the driving gear 3 will reversely push the gear teeth 40 of the driven gear 4 and at this time, the driven gear 4 and the main body 2 are rotated in a same direction, as shown in FIG. 5, and the ratchet teeth 42 on the driven gear 4 are tightly engaged with the ratchet teeth 231 on the inner wall of the receiving groove 23 to form an engaging and braking state. Thus, the driving gear 3 is impossible to be rotated any more, and hence a sleeve tool (not shown) fitted on the sleeve-engaging rod 32 of the driving gear 3 can carry out detaching or locking of bolts or nuts. When the orientating member 52 is pulled downward clockwise while the main body 2 is turned counterclockwise, the driving gear 3 will actuate the driven gear 4 to rotate and slightly shift toward the space at the lower side of the receiving groove 23, as shown in FIG. 6, letting the ratchet gears 42 on the gear teeth 40 of the driven gear 4 disengaged from the ratchet teeth 231 on the upper inner wall of the receiving groove 23 to enable the driven gear 4 to be driven by the driving gear 3 to rotate in an idling state. On the contrary, when the main body 2 is to be turned counterclockwise for use, simply pull the orientating member 52 upward counterclockwise, as shown in FIGS. 4 and 7, to have the orientating member 52 driving the interactive member 44 to rotate counterclockwise and actuate the pressing piece 45 to rotate in the through hole 43 of the driven gear 4. Simultaneously, the pressing piece 45 elastically pushed by the spring 46 will actuate the driven gear 4 to shift downward in the receiving groove 23 of the main body 2, letting the upper side of the receiving groove 23 form a space, and elastically pushed by the spring 46, the driven gear 4 will shift downward and closely contact with the lower inner wall of the receiving groove 23 of the main body 2, as shown in FIG. 7. Thus, when the main body 2 is turned counterclockwise for use, the gear teeth 30 of the driving gear 3 will be driven to rotate clockwise and force the gear teeth 40 of the driven gear 4 to turn counterclockwise to make the ratchet teeth 42 on the driven gear 4 closely engaged with the ratchet teeth 231 on the lower sidewall of the receiving groove 23 to form an engaging and braking state. At this time, the driving gear 3 is impossible to be rotated any longer and hence, the sleeve tool (not shown) fitted on the sleeve-engaging rod 32 of the driving gear 3 can be operated to detach or lock nuts or bolts. When the orientating member 52 is pulled upward counterclockwise while the main body 2 is turned clockwise, the driving gear 3 will actuate the driven gear 4 to slightly shift toward the upper space of the receiving groove 23, letting the ratchet teeth 42 on the gear teeth 40 of the driven gear 4 no longer engaged with the ratchet teeth 23 on the lower inner wall of the receiving groove 23 and enabling the driven gear 4 to be actuated by the driving gear 3 to rotate in an idling state.

As can be understood from the above description, this invention has the following advantages:

1. The driving gear 3 can really and stably be engaged and braked not to slip off by mutual engagement of the ratchet teeth 42 of the gear teeth 40 of the driven gear 4 with the ratchet teeth 231 on the inner wall of the receiving groove 23.

2. The arc-shaped surfaces 31 of the gear teeth 30 of the driving gear 3 matching with the concave surfaces 41 between every gear teeth 40 of the driven gear 4 functions to enlarge the contract area of mutual engagement of the driving gear 3 with the driven gear 4, able to carry out engaging and driving with great stability and avoid tooth skipping.

Figure 8:
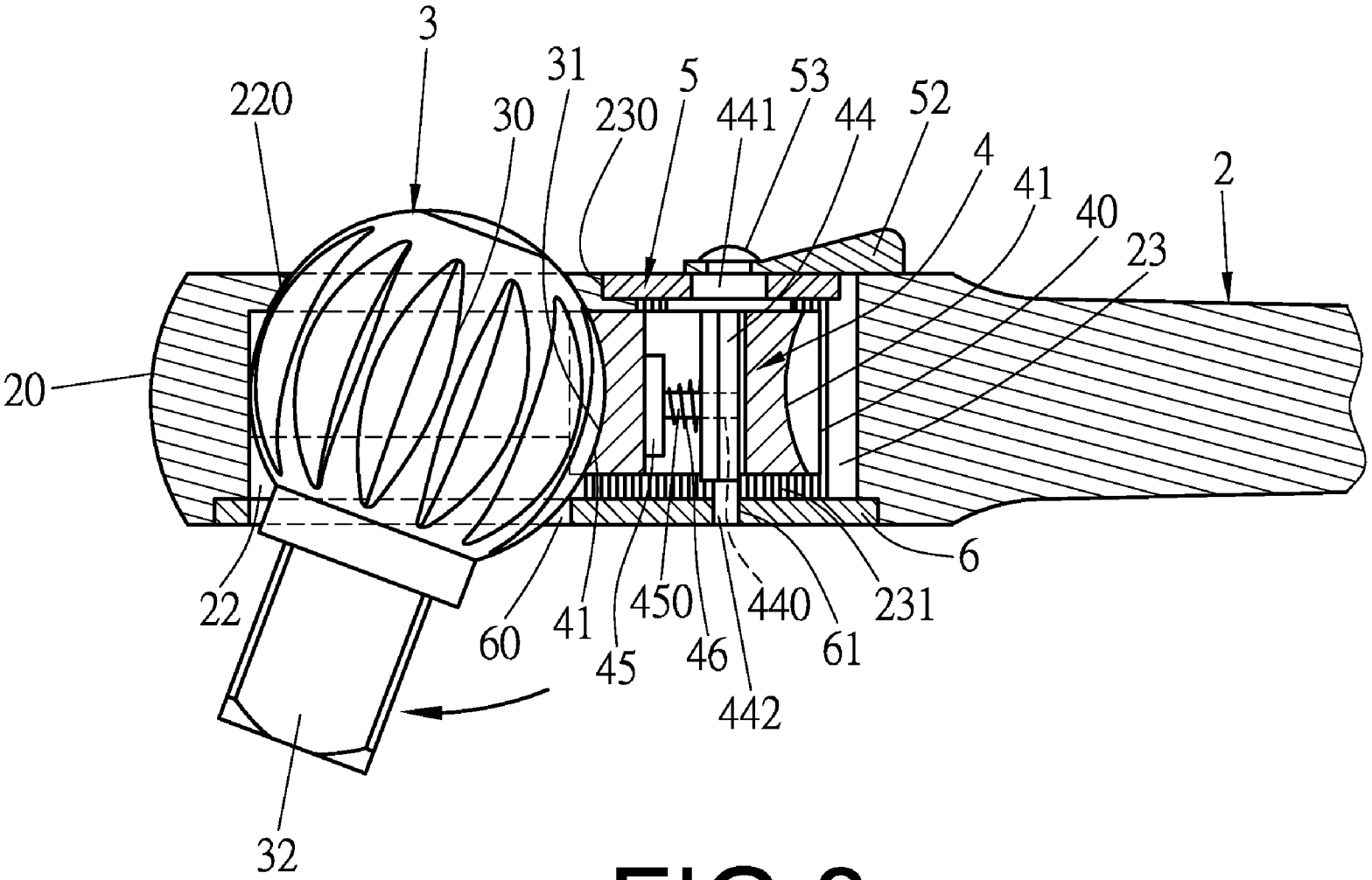
FIG. 8 is a schematic view of the sleeve-engaging rod of the driving gear rotated to shift forward for use in the present invention.
Figure 9:
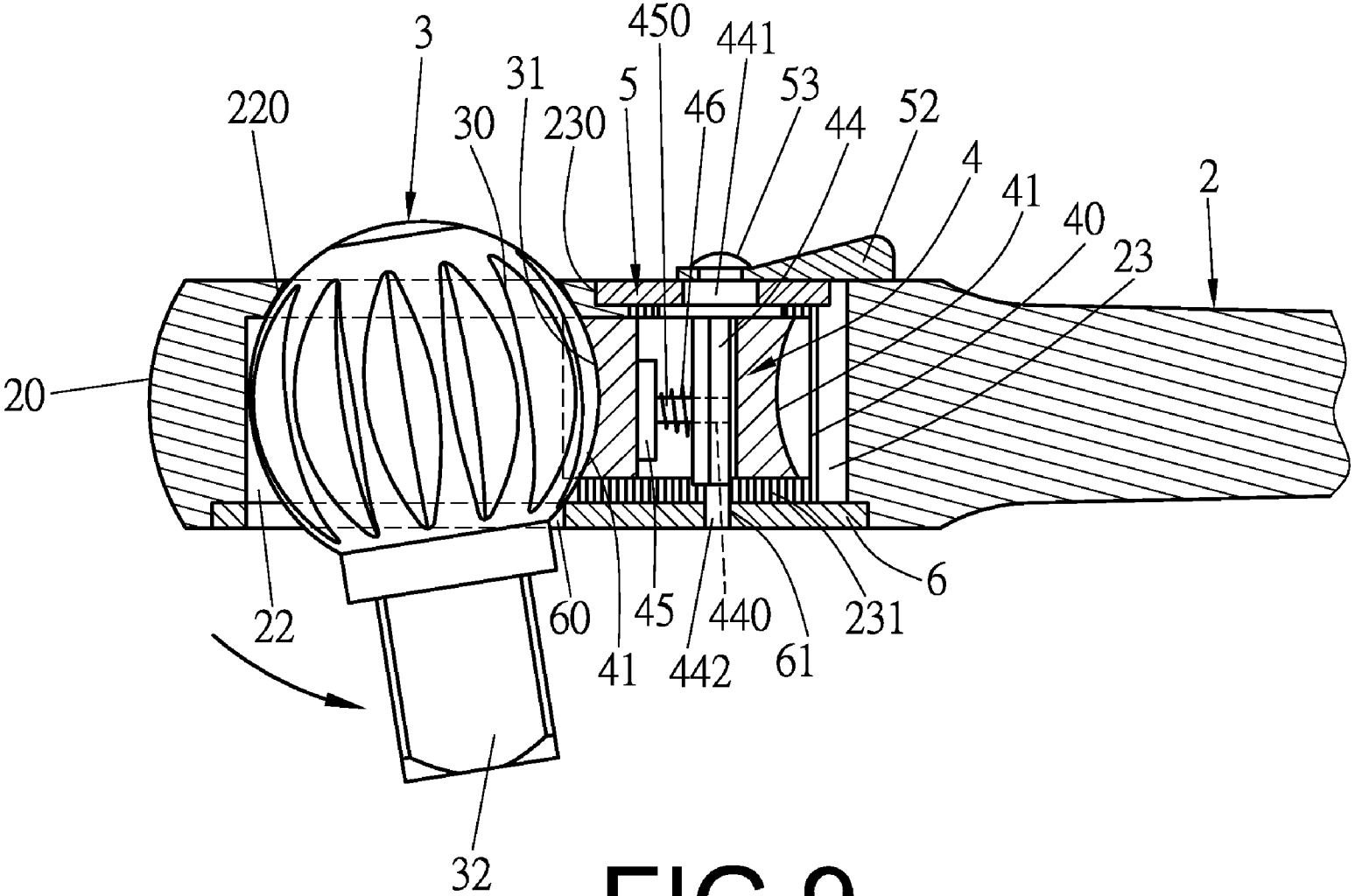
FIG. 9 is a schematic view of the engaging rod of the driving gear rotated to shift backward for use in the present invention.

3. That the arc-shaped surfaces 31 of the gear teeth 30 of the driving gear 3 match with the concave surfaces 41 between every gear teeth 40 of the driven gear 4 not only stabilize driving but also enable the sleeve-engaging rod 32 of the driving gear 3 to be adjusted backward and forward at any angle, as shown in FIGS. 8 and 9, to match different restricted space restrictions for facilitating adjustment of force-applying angles of a tool when operated, very convenient in use.

While the preferred embodiment of the invention has been described above, it will be recognized and understood that various modifications may be made therein and the appended claims are intended to cover all such modifications that may fall within the spirit and scope of the invention.

What is claimed is:

1. A ratchet wrench comprising a main body, said main body formed with an operating end having one side provided with a recessed surface, under said recessed surface disposed with an accommodating groove and a receiving groove communicating with each other, said operating end having another side bored with a through hole communicating with said accommodating groove, said main body having an outer side set with an orientating member, a driving gear received in said accommodating groove of said main body, said driving gear provided with gear teeth and a sleeve-engaging rod, a driven gear fixed in said receiving groove of said main body, said driven gear disposed with gear teeth to be meshed with said gear teeth of said driving gear, a cover plate covered on said recessed surface of said main body, said cover plate bored with a through hole for said sleeve-engaging rod of said driving gear to be inserted therethrough, said receiving groove of said main body provided with ratchet teeth on an inner wall, said driving gear being ball-shaped, each said gear tooth of said driving gear having an outer wall formed into an arc-shaped surface, a concave surface formed between every said gear teeth of said driven gear to match with said arc-shaped surfaces of said gear teeth of said driving gear, said gear teeth of said driven gear respectively secured thereon with plural ratchet teeth, said ratchet teeth of said driven gear meshed with said ratchet teeth on the inner wall of said receiving groove of said main body, said driven gear bored with a through hole received therein with an interaction member, said interaction member having one end connected with said orientating member at an outer side of said main body, said interaction member having another end positioned on said cover plate, said interaction member bored with an insert hole, a pressing piece fixed on said interaction member and received in said through hole of said driven gear, said pressing piece provided with a projecting post to be inserted in said insert hole of said interaction member, a spring fitted around said projecting post of said pressing piece, said spring located between said pressing piece and said interaction member.

2. The ratchet wrench as claimed in claim 1, wherein said operating end of said main body has another side formed with a recessed groove at a location corresponding with said receiving groove, and said recessed surface of said main body is bored with a plurality of insert holes communicating with said recessed groove, said interaction member having one end provided with a positioning projection and another end fixed with a positioning stud, a blocking plate assembled in said recessed groove of said main body, said blocking plate bored with a through hole for said positioning projection of said interaction member to be inserted therein, said blocking plate provided with threaded holes at locations respectively corresponding with said insert holes of said main body, said orientating member set at an outer side of said blocking plate, said orientating member having an insert hole inserted therein with a fixing member, said fixing member secured with said positioning projection of said interaction member, said cover plate disposed with a positioning hole for said positioning stud at another side of said interaction member to be inserted and positioned therein, said cover plate bored with insert holes at locations respectively corresponding with said insert holes of said recessed surface of said main body, plural screws respectively inserted through said insert holes of said cover plate and through said insert holes of said main body and then locked in said threaded holes of said blocking piece.

* * * * *